US005578187A

United States Patent [19]

Zitko et al.

[11] Patent Number: 5,578,187

[45] Date of Patent: Nov. 26, 1996

[54] PLATING PROCESS FOR ELECTROLESS NICKEL ON ZINC DIE CASTINGS

[75] Inventors: Mark W. Zitko, Meriden; John H. Commander, Old Saybrook; Victor J. Waldman, Milford, all of Conn.

[73] Assignee: Enthone-Omi, Inc., West Haven, Conn.

[21] Appl. No.: 545,354

[22] Filed: Oct. 19, 1995

[51] Int. Cl.[6] ..... C25D 5/00

[52] U.S. Cl. ..... 205/191; 427/405; 427/438

[58] Field of Search ..... 205/191; 427/405, 427/438

[56] References Cited

U.S. PATENT DOCUMENTS

| | | | |
|---|---|---|---|
| 2,690,401 | 9/1954 | Gutzeit et al. | 117/47 |
| 2,690,402 | 9/1954 | Crehan | 117/47 |
| 2,762,723 | 9/1956 | Talmey et al. | 117/130 |
| 2,884,344 | 4/1959 | Ramirez | 117/130 |
| 2,929,742 | 3/1960 | Minjer et al. | 117/130 |
| 2,935,425 | 5/1960 | Gutzeit et al. | 117/130 |
| 3,338,726 | 8/1967 | Berzins | 106/1 |
| 3,853,718 | 12/1974 | Creutz | 204/55 |
| 3,869,358 | 3/1975 | Nobel et al. | 204/55 |
| 3,884,774 | 5/1975 | Kessler | 204/55 |
| 3,930,081 | 12/1975 | Shinomiya et al. | 427/421 |
| 4,113,583 | 9/1978 | Oshima et al. | 204/55 |
| 4,169,771 | 10/1979 | Creutz et al. | 204/55 |
| 4,229,267 | 10/1980 | Steinecker | 204/55 |
| 4,567,066 | 1/1986 | Schultz et al. | 427/305 |
| 4,730,022 | 3/1988 | Willis | 524/800 |
| 4,792,038 | 12/1988 | Cooper | 206/180 |
| 4,904,354 | 2/1990 | Stavitsky et al. | 204/40 |
| 5,182,006 | 1/1993 | Haydu et al. | 205/213 |
| 5,194,140 | 3/1993 | Dobrovolskies et al. | 205/245 |
| 5,435,898 | 7/1995 | Commander et al. | 205/245 |
| 5,437,887 | 8/1995 | Yarkosky et al. | 427/131 |

OTHER PUBLICATIONS

Caplus: 1982: 481, 714.

Caplus: 1988: 635, 259.

Metal Finishing, 63rd Guidebook and Directory Issue, Jan. 1995, vol. 93, No. 1A, p. 402 May 7, 1986.

*Primary Examiner*—Kathryn Gorgos
*Assistant Examiner*—Kishor Mayekar
*Attorney, Agent, or Firm*—DeLio & Peterson

[57] ABSTRACT

A process is provided for plating zinc die cast substrates with an electroless nickel coating comprising depositing an electrolytic zinc layer on the substrate followed by depositing a first electroless nickel layer on the electrolytic zinc layer using a first alkaline electroless nickel bath and then depositing a finish electroless nickel layer on the first electroless nickel layer using an acidic electroless nickel bath. In a preferred embodiment, a second electroless nickel layer is deposited on the first electroless nickel layer using a second alkaline electroless nickel bath. It is preferred that at least one and preferably all of the electroless nickel baths contain an effective amount of antimony ions to enhance bath stability and metal to metal adhesion. Mechanical cleaning of the zinc die casting before plating is preferred.

7 Claims, No Drawings

PLATING PROCESS FOR ELECTROLESS NICKEL ON ZINC DIE CASTINGS

BACKGROUND OF THE INVENTION

1. Field of the Invention

The present invention relates to a process for depositing electroless nickel on zinc die cast substrates and the products made from the process, and more particularly, to a process comprising a series of metal electroplating and electroless nickel plating steps to provide a plurality of different metal layers on the zinc die cast substrate and in a preferred embodiment to the use of antimony in one or more of the electroless nickel plating baths.

2. Description of Related Art

Zinc die castings are used to make a variety of industrial and consumer products because of their low cost and ease of fabrication. The zinc die castings however, are not aesthetically pleasing and/or do not have the properties required for most products such as corrosion resistance or wearability. Accordingly, most zinc die cast products have a finish coating depending on the particular application or decorative effect required.

Electroless nickel has been used extensively to plate zinc die cast parts with a finished coating because of its many desired properties such as brightness, corrosion resistance, wearability and the like. Electroless nickel is not typically used for the direct plating of the zinc die casting, however, because of bath contamination and lack of adhesion between the zinc die casting and the electroless layer resulting in blistering and peeling of the electroless nickel layer. Processes have been developed to electrolessly nickel plate zinc die castings and one process utilizes an electrolytic copper strike coating on the zinc die casting followed by electroless nickel plating to produce the final coating. The electrolytic copper layer provides an adhesive coating for the electroless nickel layer and is likewise adhesive to the zinc die casting.

The use of electrolytic copper in industry is being sharply curtailed, however, because commercial electrolytic copper baths utilize cyanides which are toxic and environmentally undesirable. Additionally, the use of barrel plating is becoming more important then rack plating for many applications and new electroless nickel plating processes for zinc die castings must be versatile and useful for all types of plating processes including barrel plating, rack plating and immersion processes.

Bearing in mind the problems and deficiencies of the prior art, it is therefore an object of the present invention to provide a process for plating zinc die castings with electroless nickel. It is a further object of the present invention to provide a process for plating zinc die castings with electroless nickel using any electroless nickel plating process such as rack, barrel and immersion plating processes.

Another object is to produce electrolessly nickel plated zinc die casting products.

Still other objects and advantages of the invention will in part be obvious and will in part be apparent from the specification.

SUMMARY OF THE INVENTION

It has now been discovered that the objects and advantages of the present invention for plating zinc die castings with an electroless nickel coating comprises:

depositing a zinc or zinc alloy layer on the zinc die cast substrate using a zinc electroplating bath, preferably an alkaline zinc bath;

depositing a first electroless nickel layer on the zinc layer using a first alkaline electroless nickel plating bath; and depositing a finish electroless nickel layer on the first electroless nickel layer using an acidic electroless nickel plating bath.

A preferred embodiment utilizes an additional step of depositing a second electroless nickel layer on the first electroless nickel layer using, preferably, a different second alkaline electroless nickel plating bath. In highly preferred embodiments, at least one and preferably all of the electroless nickel plating baths contain an effective amount of antimony ions to provide enhanced bath stability and adhesive plated layers.

It is also preferred to clean or rough finish the castings before zinc electroplating with a highly preferred method being mechanical cleaning by tumbling the castings in a barrel by themselves or with ceramic or other particles preferably in a fluid medium.

The zinc die cast articles having an electroless nickel coating prepared by using the process of the invention comprise a zinc die cast substrate, a layer of electrolytic zinc or zinc alloy on the zinc die cast substrate, a first layer of electroless nickel deposited on the electrolytic zinc layer from a first alkaline electroless nickel bath and a finish layer of electroless nickel deposited on the first layer of electroless nickel deposited from an acidic electroless nickel bath. A preferred embodiment comprises a second layer of electroless nickel deposited on the first layer of electroless nickel which second layer is preferably deposited from a different second alkaline electroless nickel plating bath than the first bath used to plate the first electroless nickel layer. It is highly preferred that at least one and preferably all of the electroless nickel baths contain an effective amount of antimony ions to enhance bath stability and metal to metal adhesion.

DESCRIPTION OF THE PREFERRED EMBODIMENT(S)

Zinc die castings used for industrial and consumer products are very well known and are made using conventional casting techniques. Any zinc or zinc alloy die cast part can be used in the process of the invention to produce the articles of the invention. Two typical zinc die casting alloys as in ASTM B86 are shown in the following table:

| ELEMENT | ALLOY 3 | ALLOY 5 |
|---|---|---|
| Aluminum | 3.90–4.30% | 3.90–4.30% |
| Copper | 0.25 max. % | .075–1.25% |
| Magnesium | 0.02–0.05% | 0.03–0.06% |
| Iron | 0.075 max. % | 0.075 max. % |
| Lead | 0.004 max. % | 0.004 max. % |
| Cadmium | 0.003 max. % | 0.003 max. % |
| Tin | 0.002 max. % | 0.002 max. % |
| Zinc | Remainder | Remainder |

In a highly preferred embodiment, the zinc die castings are mechanically cleaned using a process such as "Harperization" which is a mechanical cleaning performed by tumbling the castings with a ceramic media and fluid in a barrel. The fluid may be any suitable aqueous or non-aqueous fluid which is substantially noncorrosive and non-reactive with the castings.

The mechanical cleaning removes scale, burs, flash, foreign material and other undesirable protrusions or adherents, and sometimes discoloration, from metal parts in a tumbling barrel. Cleaning is accomplished by impact between the parts and their rubbing together, preferably in an admixture of ceramics, abrasive materials, sawdust, leather cuttings, and various other materials to suit conditions. Working conditions within the tumbling barrel sometimes are varied to produce higher impact between the parts, with resultant surface hardening. A revolving barrel-like container in which the castings are placed is generally used.

It has been found that mechanical cleaning provides a finished plated product having enhanced adhesive metal layer characteristics and the products made using the plating steps of the invention together with mechanical cleaning are an important feature of the invention.

The zinc die castings are also preferably cleaned to remove grease and other dirt thereon. Typical cleaners are acidic, alkaline or neutral and include sodium hydroxide, sodium pyroborate, sodium metasilicate, sodium polyphosphate and sodium carbonate, together with surfactants and complexing agents and are used both by immersion techniques and electrolytic techniques. Organic solvents may also be used alone or in admixture with the above chemicals.

The mechanical cleaning and chemical cleaning steps may generally be performed in any order.

The chemically and/or mechanically cleaned zinc die castings are then preferably etched and then provided with an electrolytic strike coating of zinc or zinc alloy. The etchant may be any suitable material and is preferably acidic, e.g., $H_2SO_4$. Any zinc electroplating bath may be used and a number of patents have been issued over the years disclosing such baths including: U.S. Pat. Nos. 3,853,718; 3,869,358; 3,884,774; 4,113,583; 4,169,771; 4,229,267; 4,730,022; 4,792,038; 5,182,006; 5,194,140; and 5,435,898. The disclosure of these patents are hereby incorporated by reference.

The preferred zinc electroplating bath is alkaline and contains a zinc compound and an alkali hydroxide. The zinc salt may be any soluble salt and is usually zinc oxide and the base sodium hydroxide and the predominant zinc species in the bath at high pH ranges is believed to be the zincate ion. The zinc bath may also contain zinc alloy ingredients such as nickel, cobalt and iron and combinations thereof to provide alloys of zinc and nickel; zinc and cobalt; zinc, nickel and cobalt; zinc and iron; and zinc, iron and cobalt.

The composition of the zinc electroplating bath is generally about 5 to 25 g/l and up 200 g/l, e.g., 100 g/l of the zinc compound and about 75 g/l to 500 g/l of the alkali hydroxide. A preferred zinc electroplating bath comprises about 7.5 to 15 g/l zinc and 100 to 135 g/l sodium hydroxide.

A chelating agent is normally employed in the bath in an effective amount to maintain the metals in the bath in solution. The chelating agent used herein should complex the metal ions to an electrodepositable extent in a strong alkalinity of a pH of above 13 and thus permit their stable dissolution. Levels of about 1–150 g/l or more may be employed and suitable chelating agents includes citrates, tartrates, gluconates and glycollates, amino alcohols, poly amines, aminocarboxylic acid salts, polyhydroxy alcohols, sorbitol and thioureas. The plating bath may also contain additives of the type conventionally employed in alkaline zinc electroplating baths and includes such materials as brightening agents, grain refiners, and the like.

The zinc die casting may be electroplated over a wide range of temperatures of about 10° to 100° C., typically from 20° to 50° C. preferably 25° to 32° C. for 5 to 30 minutes, preferably 10 to 20 minutes. The current desities employed may range up to 200 amperes per square foot (ASF) or more with a preferred range being about 1 to 50. A plating thickness of up to about 1 mil or higher usually 0.1 to 0.3 mils may be plated although higher or lower thicknesses may be employed for certain applications.

Electroless nickel baths are also very well known in the industry and any electroless nickel bath may be used in the process of the invention. Other electroless baths may also be used such as Ni-Co, Co, and the like but for convenience, the following description will be directed to electroless nickel plating baths. Broadly stated, the electroless nickel bath contains 1) a source of metal ions, 2) a reducing agent such as hypophosphite or amine borane, 3) an acid or hydroxide pH adjuster to provide the required pH and 4) a complexing agent for metal ions sufficient to prevent their precipitation in the solution. Compositions for depositing electroless nickel are described in U.S. Pat. Nos. 2,690,401; 2,690,402; 2,762,723; 2,935,425; 2,929,742; and 3,338,726. Other useful compositions for depositing nickel and its alloys are disclosed in the 63rd Guidebook and Directory Issue of The Metal Finishing for January 1995, Volume 93, Number 1A, Elsevier Science, Inc., page 402. The foregoing publications are included herein by reference.

The nickel ion may be provided by the use of any soluble salt such as nickel sulfate, nickel chloride, nickel acetate, nickel sulfamate and mixtures thereof. The concentration of the nickel in solution may vary widely and is about 0.1 to 100 g/l, preferably about 2 to 50 g/l, e.g., 2 to 10 g/l.

The reducing agent is usually the hypophosphite ion supplied to the bath by any suitable source such as sodium, potassium, ammonium and nickel hypophosphite. Other reducing agents such as amine boranes, borohydrides and hydrazine may also suitably be employed. The concentration of the reducing agent is generally in excess of the amount sufficient to reduce the nickel in the bath.

The baths will be acid or alkaline depending on the plating step being performed. The acid or alkaline pH adjuster may be selected from a wide range of materials such as ammonium hydroxide, sodium hydroxide, hydrochloric acid and the like. The pH of the acid bath usually ranges from about 2 to 5.5, preferably 4.5 to 5.5 and the alkaline bath from about 8–14, preferably 8–11.

The complexing agent may be selected from a wide variety of materials such as lactic acid, malic acid and those containing anions such as acetate, citrate, glycollate, pyrophosphate and the like, with mixtures thereof being suitable. Ranges for the complexing agent, based on the anion, may vary widely, for example, about 1 to 300 g/l, preferably about 5 to 50 g/l.

The electroless nickel plating baths may also contain other ingredients known in the art such as buffering agents, bath stabilizers, rate promoters, brighteners, etc.

It has been found that the use of antimony ions in the electroless nickel plating baths provide enhanced bath stability and metal adhesion properties. Amounts of about 10 to 500 ppm preferably 30 to 60 ppm may be employed. The antimony may be supplied to the bath in any suitable form such as antimony potassium tartrate and antimony trifluoride.

The use of antimony in electroless nickel plating baths is described in U.S. Pat. No. 2,884,344 which relates to electroless nickel plating on metal surfaces. The patent shows the need for two or more elements selected from arsenic, antimony and bismuth to accelerate the plating process and to stabilize the bath against catalytic decomposition. U.S. Pat. No. 5,437,887 is directed to making aluminum memory disks and utilizes antimony or cadmium in electroless nickel phosphorous baths to enhance the retention of the original magnetic properties of the plating after exposure of the disks to elevated temperatures. U.S. Pat. No. 3,930,081 is directed to forming a coating on a zinc surface with an acidic displacement solution (not an electroless nickel plating bath) containing nickel, cobalt or iron and a desensitizing ion selected from antimony, tin, copper, lead, germanium, vanadium, arsenic and tungsten.

A suitable electroless nickel plating bath may be formed by dissolving the ingredients in water and adjusting the pH to the desired range.

The zinc coated zinc die casting is plated with an alkaline electroless nickel bath with a strike coating or to any desired thickness. Preferably, the part is immersed in the bath to plate a thin nickel coating adequate to provide a suitable base for the thick deposits of the final nickel plate using a different acidic electroless nickel bath. Thicknesses may range up to about 1 mil or higher, typically 0.1 to 0.3 mils. An immersion time of 5 to 60 minutes, preferably 10 to 30 minutes usually provides the desired coating, depending on bath parameters. A temperature range of about 25° C. to boiling, e.g., 100° C., may be employed, with a range of about 80° to 95° C. being preferred.

In a preferred embodiment, a second electroless nickel layer is deposited on the first electroless nickel layer using preferably a different second alkaline electroless nickel bath. Similar thicknesses and plating times for the second electroless nickel layer may be used as for the first electroless nickel layer.

The next step is to complete the nickel plating to the desired thickness and finish physical characteristics by immersing the nickel coated part in an acidic electroless nickel plating bath which is maintained over a temperature range of about 30° C. to 100° C., e.g., boiling, preferably 80° C. to 95° C. A thickness up to 5 mils. or higher may be employed, with a range of about 0.1 to 2 mils e.g. 0.3–0.5 mils being used for most applications. An immersion time of 30 to 60 minutes is typically used. It is preferred to rinse the electrolessly coated substrates between plating steps.

It will be appreciated by those skilled in the art that the rate of electroless plating may be influenced by many factors including (1) pH of the plating solution, (2) concentration of reductant, (3) temperature of the plating bath, (4) concentration of soluble nickel, (5) ratio of the volume of bath to the area plated, (6) presence of soluble fluoride salts (rate promoters) and (7) presence of wetting agent and/or agitation, and that the above parameters are only provided to give general guidance for practicing the invention; the invention residing in the use of a series of electrolytic zinc and electroless nickel plating steps as herein before described to provide a zinc die casting having enhanced metal adhesion and other properties.

The composition and process of the present invention will now be more fully illustrated by the following specific examples which are illustrative and in no way limitative and wherein all parts and percentages are by weight and temperatures in degrees centigrade unless otherwise noted.

EXAMPLE

Mechanically cleaned (Harperized) and chemically cleaned zinc die castings about 1×2×2 inch of Alloy 3 supra were plated using the following process. The castings were first etched in an acidic etch solution for 2 minutes at 25° C. After rinsing with water the etched castings were zinc electroplated using a bath containing 11.25 g/l zinc and 105 g/l NaOH. The bath had a pH of 14 and the castings were barrel plated at 10 amps per square foot (ASF) for 15 minutes at 20° C. A thickness of about 0.1 mil was plated.

After a cold water rinse, the castings were barrel plated at 90° C. for 30 minutes in a first electroless commercial alkaline nickel plating bath using sodium hypophosphite as the reducer and having a pH of 9. The bath contained 40 ppm antimony.

After a cold water rinse, the nickel plated castings were barrel plated under the same conditions as the first electroless nickel plating in a second different electroless nickel plating bath having the same composition as the first electroless nickel bath. Both nickel platings had a thickness of about 0.1 mil.

The plated castings were then rinsed with cold water and barrel plated in a bright electroless commercial nickel plating bath having a pH of 5.2 at 85° C. for 30 minutes. The bath contained 40 ppm antimony. The nickel plating had a thickness of about 0.3 mil.

The plated parts were bright and had excellent adhesion (no blistering or delamination) after heating at 350° F. for 30 minutes.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A process for plating a zinc die casting with an electroless nickel coating comprising:

mechanically cleaning the zinc die casting;

depositing a zinc or zinc alloy layer on the casting using a zinc electroplating bath having a pH greater than about 13;

depositing a first electroless nickel layer on the zinc electroplated layer using a first alkaline electroless nickel bath containing antimony ions in an effective amount to provide enhanced bath stability and metal adhesion properties; and depositing a finish electroless nickel layer on the electroless nickel layer thereof using an acid electroless nickel bath.

2. The process of claim 1 further comprising depositing a second electroless nickel layer on the first electroless nickel layer using a second alkaline electroless nickel bath containing antimony ions in an effective amount to provide enhanced bath stability and metal adhesion properties.

3. The process of claim 1 wherein the zinc die casting is mechanically cleaned before being plated by tumbling the castings together.

4. The process of claim 3 wherein the tumbling is performed in a barrel with fluid and ceramic media.

5. The process of claim 1 wherein the zinc die castings are plated in each of the plating steps by barrel plating.

6. The process of claim 2 wherein the zinc die castings are plated in each of the plating steps by barrel plating.

7. The process of claim 3 wherein the zinc die castings are plated in each of the plating steps by barrel plating.

* * * * *

UNITED STATES PATENT AND TRADEMARK OFFICE

CERTIFICATE OF CORRECTION

PATENT NO. : 5,578,187

DATED : November 26, 1996

INVENTOR(S) : Mark W. Zitko, et. al.

It is certified that error appears in the above-indentified patent and that said Letters Patent is hereby corrected as shown below:

Title page, item [73], the correction should read : --ENTHONE-OMI, INC.--

Signed and Sealed this

Eleventh Day of March, 1997

*Attest:*

Bruce Lehman

BRUCE LEHMAN

*Attesting Officer*

*Commissioner of Patents and Trademarks*